US005848543A

United States Patent [19]

White

[11] Patent Number: 5,848,543

[45] Date of Patent: Dec. 15, 1998

[54] STRIP MILL WITH MOVABLE COILING FURNACE

[75] Inventor: Jeffrey C. White, Allison Park, Pa.

[73] Assignee: Tippins Incorporated, Pittsburgh, Pa.

[21] Appl. No.: 892,418

[22] Filed: Jul. 14, 1997

[51] Int. Cl.[6] ..... B21B 41/02; B21B 27/06

[52] U.S. Cl. ..... 72/202; 72/231

[58] Field of Search ..... 72/200, 201, 202, 72/226, 227, 228, 229, 199, 231

[56] References Cited

U.S. PATENT DOCUMENTS

| | | | |
|---|---|---|---|
| 2,658,741 | 6/1953 | Schmidt et al. | 263/3 |
| 3,645,120 | 2/1972 | Lind et al. | 72/134 |
| 4,291,460 | 9/1981 | Stoehr | 29/820 |
| 4,297,865 | 11/1981 | Smith | 72/231 |
| 4,319,474 | 3/1982 | Gronbech | 72/229 |
| 4,420,960 | 12/1983 | Grasshoff | 72/202 |
| 4,442,690 | 4/1984 | Hirschmanner et al. | 72/128 |
| 4,761,983 | 8/1988 | Ginzburg et al. | 72/202 |
| 5,479,807 | 1/1996 | Moser | 72/202 |
| 5,494,264 | 2/1996 | Wolff et al. | 266/103 |

*Primary Examiner*—Joseph J. Hail, III
*Assistant Examiner*—Rodney Butler
*Attorney, Agent, or Firm*—Webb Ziesenheim Bruening Logsdon Orkin & Hanson, P.C.

[57] ABSTRACT

A strip mill using movable coiling furnaces that are in a first position horizontally aligned with the pass line eliminates the need to deflect the strip into the furnaces. In a second position the movable furnaces are displaced from the pass line to allow strip to pass without obstruction. The roller table is also movable to permit the furnaces to align with the pass line but may be aligned with the pass line when the furnaces are displaced.

21 Claims, 4 Drawing Sheets

STRIP MILL WITH MOVABLE COILING FURNACE

FIELD OF THE INVENTION

This invention relates to a strip mill and specifically an improved coiling furnace arrangement for a reversible hot strip mill.

BACKGROUND OF THE INVENTION

In recent years coiling furnaces have been utilized with reversing hot strip mills. A hot strip mill typically processes slabs of steel up to about 10 inches thick and reduces the slab to an elongated strip of steel. A single hot strip mill may process 1,000,000 tons of steel or more per year for use as specialized steel products.

In general, each of these furnaces in a hot strip mill is provided with an enclosure in which a rotatable coiling drum is mounted. The strip being worked upon is wound onto the drum along a roller table after being passed through a rolling mill, as exemplified in U.S. Pat. No. 5,269,166. The strip is fed into the coiling furnace through an opening in the furnace enclosure. A diverter built into the furnace enclosure guides the strip to the drum.

As an overview, FIG. 1 illustrates a strip mill having such a coiling furnace. While technically a slab is reduced to a strip of material in the hot strip mill, the term strip will be used herein to represent both strips of material and the slabs as they are reduced in thickness to a coilable thickness. In general, a strip to be worked upon comes to the mill 10 from, for example, a continuous caster and heat equalization furnace or from a slabbing mill and a slab reheat furnace. The strip passes along roller tables 11 and the first pass through the mill 10 will, for purposes of discussion, be made from left to right. A diverter 12 under both the left and right coiling furnaces 14 may be pivoted up to seal the access opening 15 of both furnaces 14 to allow a strip of material to move along the pass line 16 under both coiling furnaces 14. Pinch rollers are raised out of the way at this point. The strip will be passed repeatedly through a rolling mill 20 until the strip is thin enough to be coiled. At that time the diverter 12 on one of the coiling furnaces 14 will be lowered to the open position to intercept and direct the leading edge of the strip into access opening 15 of the respective coiling furnace 14. A second diverter 22 may be pivoted up from the furnace enclosure 16 to direct the leading edge of the strip into a coiling drum 24 of the coiling furnace 14. The strip will be coiled until its trailing edge passes beneath the other coiling furnace 14 and through the rolling mill 20. At this point the diverter 12 of the other coiling furnace 14 will be lowered to intercept and direct to the drum 24 the trailing edge of the strip when the mill is reversed. The strip will then be unwound from the drum 24 of one furnace 14, passed through the rolling mill 20, and wound onto the drum 24 of the other furnace 14.

A continuing challenge in the development of reversible hot strip mills is to process the extreme leading and trailing sections of the strip to produce dimensional and metallurgical properties similar to those of the mid section of the strip. Because the coiling furnace 14 will wind the strip to a point up to but not beyond the pinch roll 18, a trailing section of strip between the rolling mill 20 and the coiling furnace 14 remains exposed to ambient conditions while the remainder of the strip is resident in the furnace 14. As a result, the trailing section of the strip cools and hardens, requiring a greater demand on the roll forces of the rolling mill 20. This produces a trailing edge section of strip which may not possess the requisite flatness or the same metallurgical properties relative to the mid section of the strip. This same phenomenon occurs when the mill is reversed and the other end section (previously the leading edge section but now the trailing edge section) is unheated for a period. These end sections of the strip are therefore heated only half as frequently as the remainder of the strip.

To minimize this problem, the feed rate of the strip should be as high as possible, thereby minimizing the time the trailing and leading sections of the strip are unheated. However, the feed rate has an upper limit dictated by the path created by the diverter 12 in feeding the strip to the coiling furnace 14. An excessive speed rate causes the strip to kick up when it hits the diverter 12 making it difficult for the strip to thread into the drum 24. Additionally, when the strip is uncoiled from the drum 24, the sudden change in direction from the diverter 12 to the pass line 16 causes the strip to flap. One solution for these problems would be to use a longer diverter 12 having a milder slope into the coiling furnace 14. However, by doing so, the length of the path to the coiling furnace is undesirably increased, thereby further exposing the strip to cooling.

The current solution to the problems of out of flatness and different metallurgical properties that may be imparted to the leading and trailing edge sections of the strip is to remove these sections and delegate them to scrap.

If the feed rate of the strip when threaded into or from a drum could be increased, the leading and trailing edge sections of the strip would remain hotter, thereby improving the uniformity of the dimensional and metallurgical properties in these sections. By doing so, a greater portion of the strip previously delegated to scrap would now be usable product.

Another disadvantage exists when the furnace 14 is vertically offset from the pass line 16. The strip must now move against gravity up the diverter 12 into the coiling furnace 14. The ability of the strip mill to produce light gauge material may be limited because thin strip may buckle when it is being driven up the diverter 12 into the coiling furnace 14.

An object of the present invention is to minimize the deflection from the pass line of a strip traveling between a rolling mill and a coiling furnace. This would permit higher feed rates of the strip into the coiling furnaces thereby maintaining the leading edge and trailing edge sections at a temperature more uniform with the mid section of the strip to produce metallurgical and dimensional properties at the leading edge and trailing edge sections which more closely resemble those properties of the mid section of the strip.

SUMMARY OF THE INVENTION

A strip mill for working a strip of material is comprised of a roller and a roller table defining a pass line and positioned on opposite sides of the rolling mill. The strip mill is adapted to pass the strip of material to and from the rolling mill and a pair of coiler furnaces positioned on opposite sides of the rolling mill. Each furnace has an access opening for receiving the strip to a drum within the furnace enclosure and for discharging the strip from the furnace. At least one of the furnaces is movable between a first position in which the furnace access opening extends into the pass line to intercept the strip and a second position in which the access opening is away from the pass line and the pass line is unobstructed by the furnace.

DESCRIPTION OF THE PREFERRED EMBODIMENT

Figure 2:
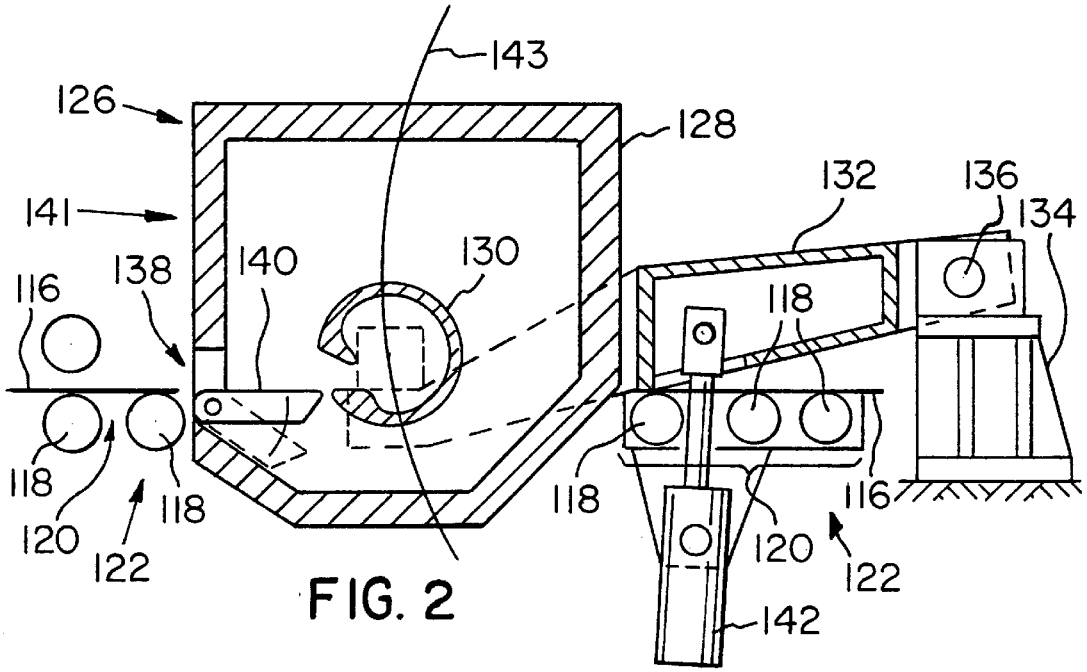
FIG. 2 is a vertical section through the coiling furnace region of a hot strip mill with the coiling furnace access opening extending into the pass line in accordance with the first embodiment of the present invention.
Figure 3:
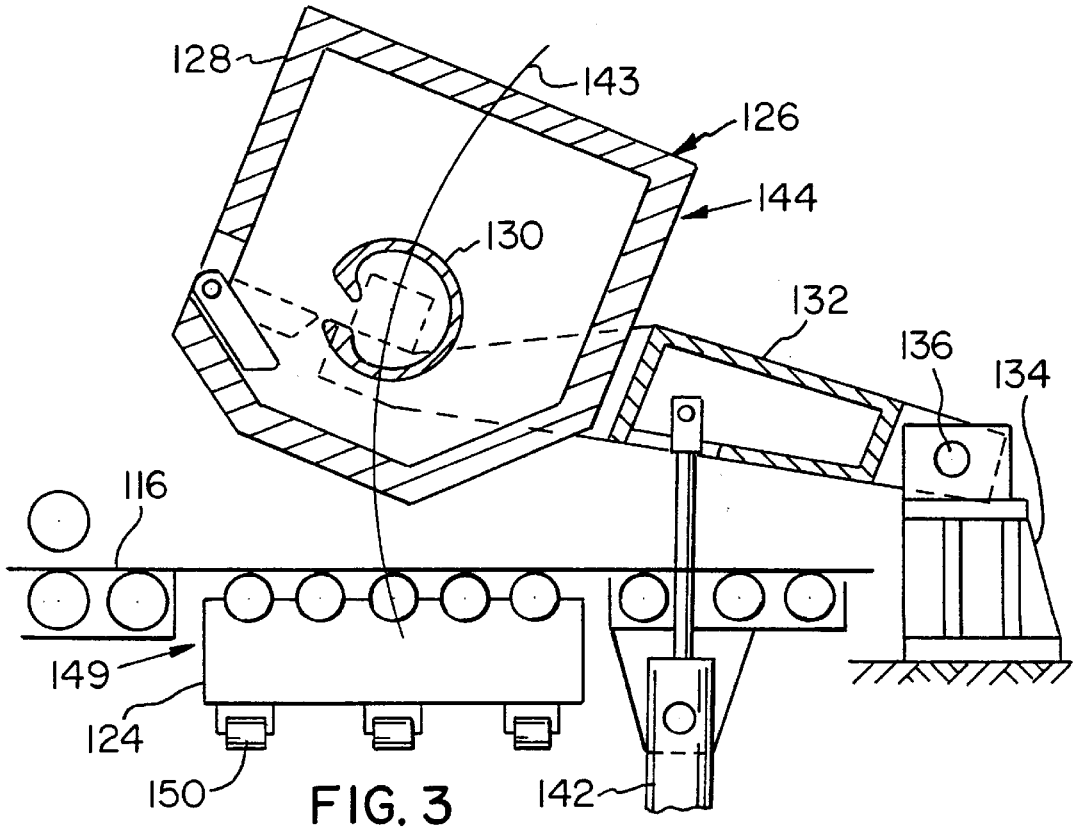
FIG. 3 is a vertical section of the first embodiment of the invention with the access opening and the coiling furnace moved from the pass line.
Figure 4:
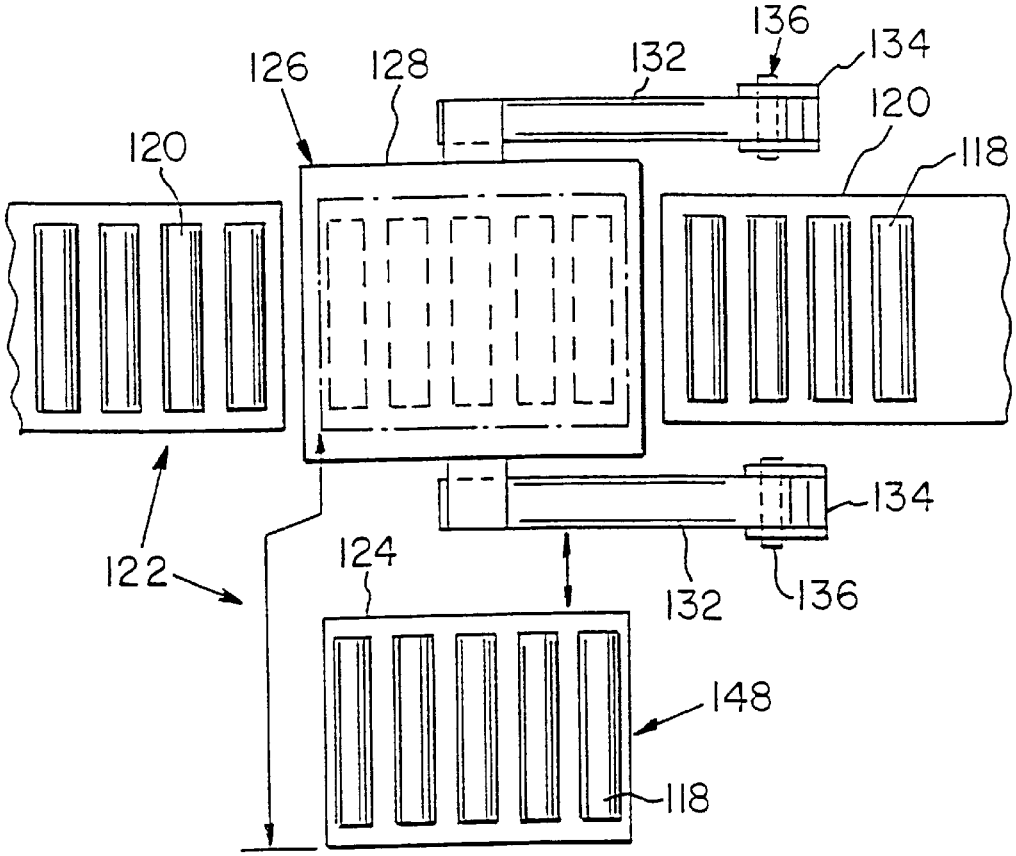
FIG. 4 is a plan view of the coiling furnace region of the first embodiment of the invention.

FIGS. 2–4 illustrate the first embodiment of the invention. As illustrated in FIG. 2, a pass line 116 is defined by rollers 118 on a fixed portion 120 of a roller table 122. The roller table 122 is also made up of a traveling portion 124 (FIG. 4).

A coiling furnace 126 made up of a furnace enclosure 128 with a coiling drum 130 therein is supported by arms 132 fixed at one end to the furnace enclosure 128 and rotatably secured at the other end to a base 134 with a pivot 136. The coiling furnace 126 has an access opening 138 (FIG. 2) within the enclosure 128 to accept a strip of material from the pass line 116. A gate 140 is pivotably mounted on the furnace enclosure 128 at the opening 138 to provide a bridge between the furnace enclosure 128 and the coiling drum 130 for the strip of material. In such a fashion, a strip of material traveling along the pass line 116 toward the coiling furnace 126 oriented in a first position 141 may travel directly to the drum 130 without any change in direction until the strip begins to thread within the drum 130. When the strip is engaged in the drum 130, the gate 140 is retracted to avoid interfering with rolling the strip onto the drum 130.

In the illustrations shown in FIGS. 2, 3 and 4, there is no change in vertical distance between the pass line 116 and the access opening 138. This eliminates the disadvantages incurred by moving the strip against gravity into the drum 130. An actuator 142 supports the coiling furnace 126 at the arms 132 and displaces the coiling furnace 126 along an arc 143 to a second position 144 illustrated in FIG. 3.

As shown in FIG. 3, the traveling portion 124 of the roller table 122 is comprised of rollers 118 which are intended to operate along the pass line 116 when the furnace 126 is moved to the second position 144. However, as shown in FIGS. 2 and 4, with the furnace 126 in the first position 141, the traveling portion 124 of the roller table 122 must be in a disengaged position 148. Wheels 150 support the frame of the traveling portion 124 of the roller table 122 enabling it to roll from the disengaged position 148 to the engaged position 149 illustrated in FIG. 3.

The structure used to support and move the coiling furnace 126 comprised of the arms 132, the base 134 and the actuator 142 straddles the pass line 116 to avoid interfering with the strip moving along the pass line 116 when the coiling furnace 114 is in the second position 144 and the traveling portion 124 of the roller table 122 is in the engaged position 149 as shown in FIG. 3.

Figure 1:
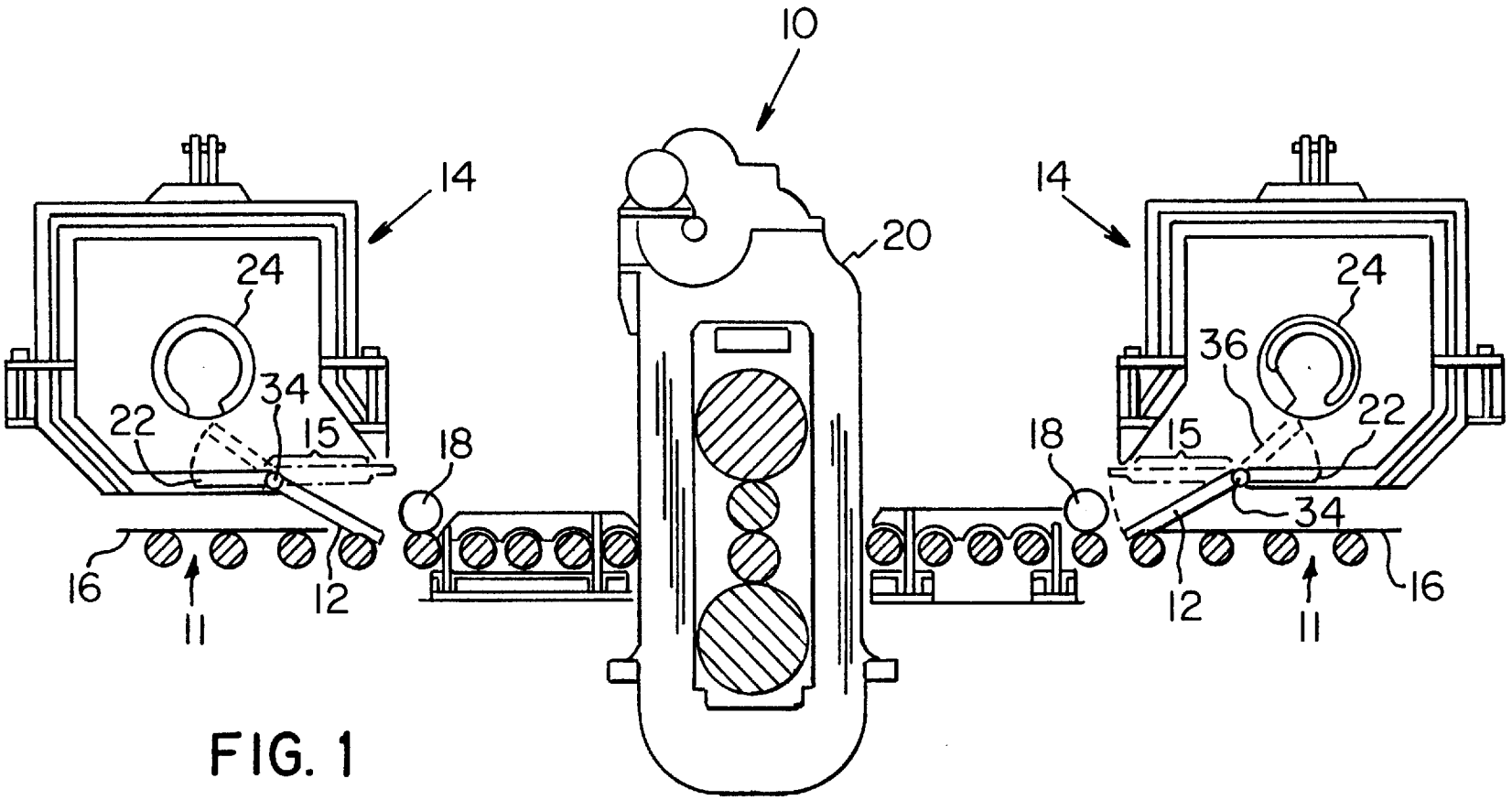
FIG. 1 PRIOR ART
FIG. 1 is prior art and is a vertical section through a reversible hot strip mill.

Positioning the access opening 138 of the coiling furnace enclosure 128 at the same level as the pass line 116 not only permits introduction of the strip of material to the drum 130 with minimum deflection but furthermore defines a shorter path for the strip to travel to the drum 130 since now the leading edge of the strip of material enters the furnace 126 without the need for a diverter 12 such as that shown in the FIG. 1 prior art. A further benefit is the elimination of the need to move the strip upward against gravity to thread the strip into the drum 24 as again illustrated in FIG. 1.

Figure 5:
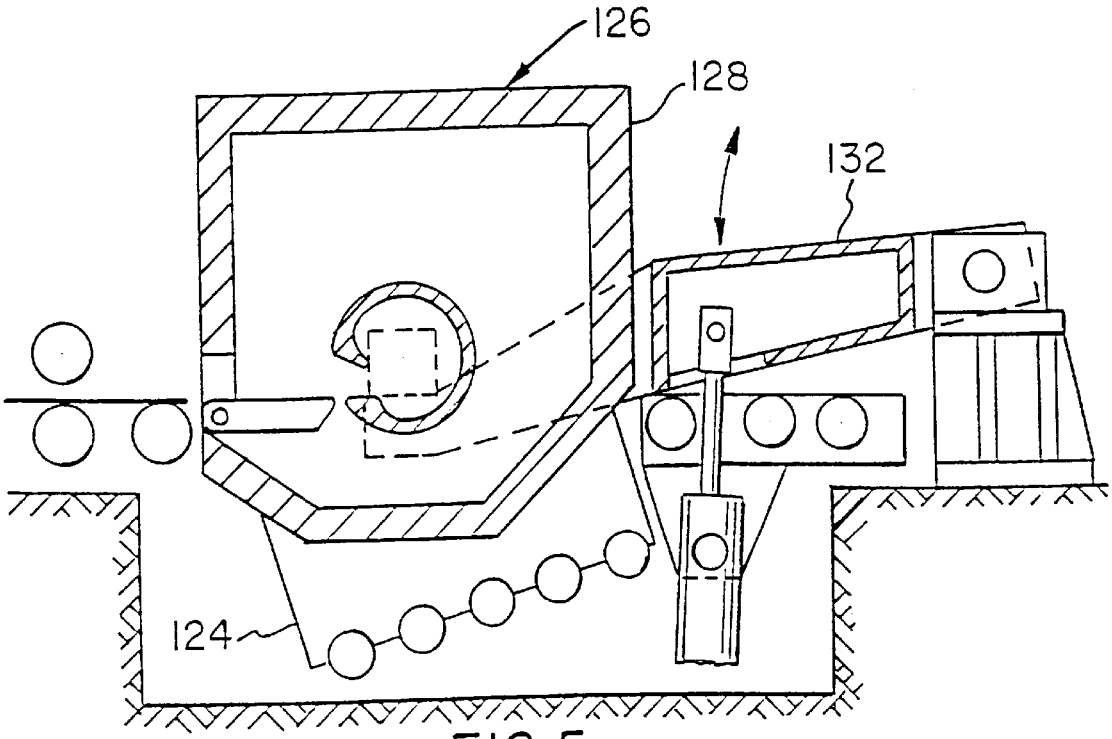
FIG. 5 is a vertical section through the coiling furnace region of a hot strip mill in accordance with a second embodiment of the present invention.

While FIGS. 2–4 show a traveling portion 124 of the roller table 122 which is independently moved from an engaged position 149 to a disengaged position 148, it is entirely possible to secure the traveling portion 124 to the arm 132 or to the furnace enclosure 128 such that, unlike the embodiment illustrated in FIG. 4, the traveling portion 124 does not move independently from the furnace 126 but is attached to and moves as an integral part of the arm 132 or furnace enclosure 128 as illustrated in FIG. 5. When the furnace 126 is in the first position 141, the traveling portion 124 is in a disengaged position 148 as shown in FIG. 4, while when the furnace is in the second position 144 the traveling portion 124 is in the engaged position 149 as shown in FIG. 3. Typically, there is a flume beneath the coiling furnace 126 which would provide sufficient clearance to the traveling portion 124 of the roller table 122 when it is positioned beneath the coiling furnace 126.

What has so far been discussed is directed to the coiling furnace moving between a first position and a second position along an arc defined by a pivoting arm; however, it is entirely possible to move the furnace between these positions along a different path and using other mechanisms.

Figure 6:
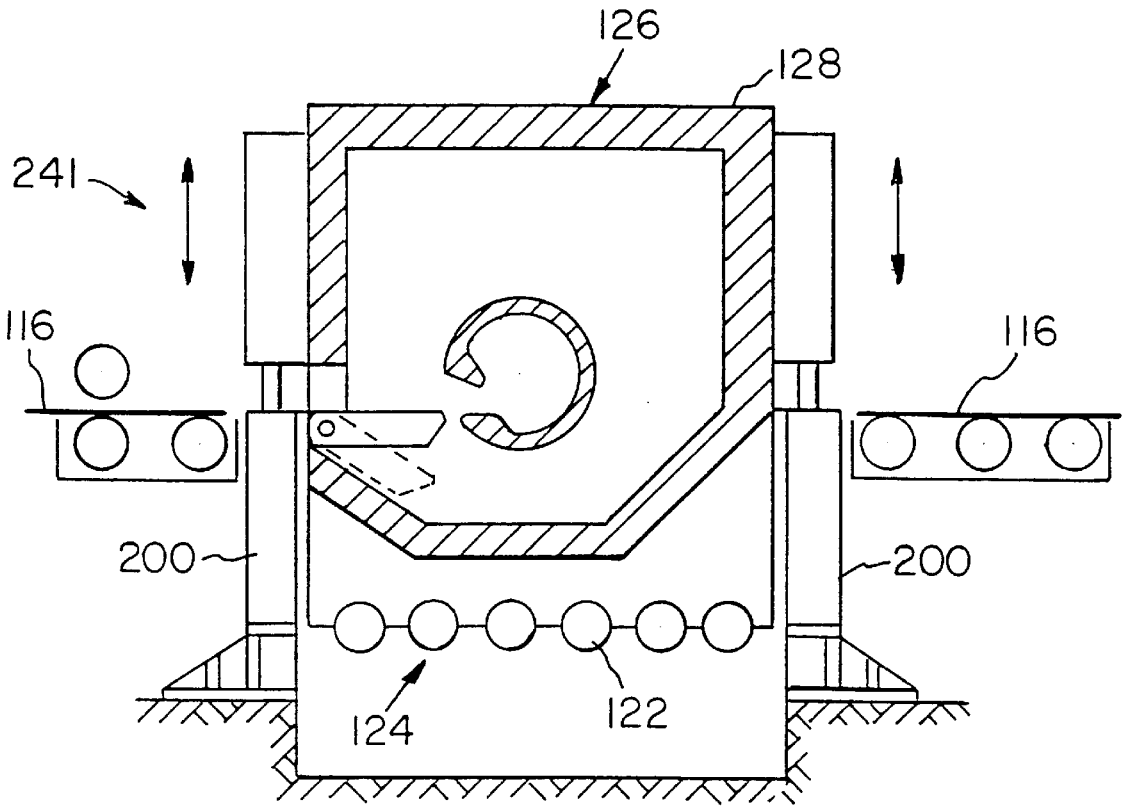
FIG. 6 is a vertical section through the coiling furnace region of a hot strip mill in accordance with a third embodiment of the present invention.

FIG. 6 shows a coiling furnace 126 supported by vertically oriented actuators 200 which are capable of positioning the furnace 126 in either a first position 241 or in a second position (not shown) away from the pass line 116 in which the actuators 200 are extended to lift the furnace 126. Then the traveling portion 124 of the roller table 122 may be positioned along the pass line 116. Just as in FIG. 5, the traveling portion 124 of the roller table 122 may be mounted directly to the furnace enclosure 128 so that it will move as a unit with the furnace 126 or it may be moved independently as shown in FIGS. 3 and 4.

Figure 7:
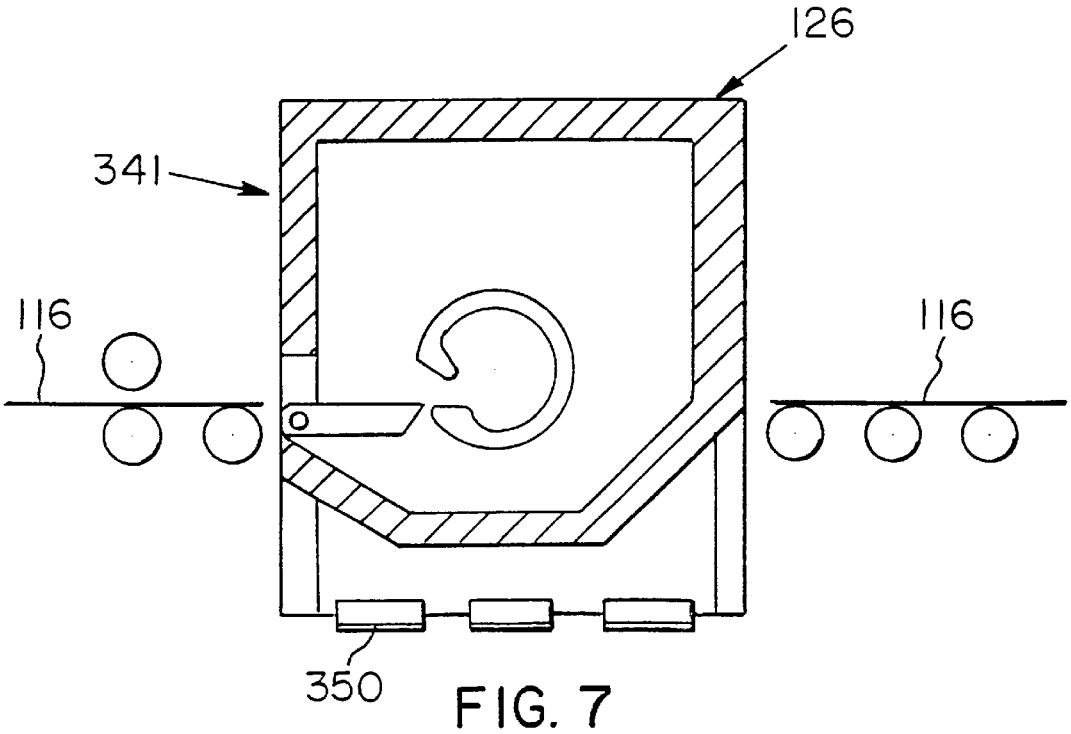
FIG. 7 is a vertical section through the coiling furnace region of a hot strip mill in accordance with a fourth embodiment of the present invention.

FIG. 7 illustrates an arrangement by which the coiling furnace 126 is in a first position 341. This arrangement is similar to that disclosed in FIGS. 2–4 with the exception now that the coiling furnace 126 can be displaced horizontally in the same fashion as the traveling portion 124 of the roller table 122. The coiling furnace 126 is supported by a frame resting upon wheels 350 which permit the furnace 126 to roll from a first position 341 to a second position horizontally displaced from the first position 341. The traveling portion 124 of the roller table 122 may be horizontally displaced using wheels 150 on a frame supporting the roller table 122 as shown in FIGS. 3–4.

From this discussion it should be obvious that the traveling portion 124 of the roller table 122 may move as an integral part with the furnace enclosure 128, and may also move in a variety of other ways. FIGS. 2–4 illustrate the traveling portion 124 moving horizontally along wheels 150. The traveling portion 124 may, just as the furnace 126, be moved about a pivot between the engaged and disengaged positions or may be independently lowered into and raised from the pit associated with the coiling furnace 114 to assume the disengaged and the engaged positions, respectively.

While a number of embodiments of the invention have been described above for the purposes of illustration, it will be evident to those skilled in the art that variations of the details may be made without departing from the spirit of the invention, the scope of which is defined in the appended claims.

What is claimed is:

1. A strip mill for working a strip of material comprised of:

a) a roller mill;

b) a roller table defining a pass line positioned on opposite sides of the roller mill to pass the strip of material to and from the roller mill; and c) a coiling furnace positioned on at least one side of the roller mill adjacent the roller table with the furnace having an access opening for both receiving and discharging the strip to a coiling drum mounted within a furnace housing, wherein the furnace is movable between i) a first position in which the furnace opening extends into the pass line; and ii) a second position in which the furnace access opening is away from the pass line and the pass line is unobstructed by the furnace.

2. The strip mill of claim 1 wherein an arm is secured at one end to the furnace enclosure and at the other end to a pivoting arm controlled by an actuator which when activated moves the furnace along an arc between the first position and the second position.

3. The strip mill of claim 2 further including a gate pivotally mounted to the furnace enclosure to provide a bridge between the roller table and the coiling drum for the strip when the tail of the strip is entering or exiting the furnace and to retract at other times.

4. The strip mill of claim 1 wherein the furnace moves vertically between the first position and the second position.

5. The strip mill of claim 1 wherein the furnace moves horizontally between the first position and the second position.

6. The strip mill of claim 2 wherein the roller table has a fixed portion and a traveling portion and wherein the traveling portion is moved to an engaged position aligned with the pass line when the furnace is in the second position and is moved to a disengaged position away from the pass line when the furnace is in the first position.

7. The strip mill of claim 6 wherein the traveling portion of the roller table is secured to the furnace enclosure such that when the furnace is moved to the first position the traveling portion is moved to the disengaged position and when the furnace is moved to the second position the traveling portion is moved to the engaged position.

8. The strip mill of claim 6 wherein the traveling portion of the roller table moves independently from the furnace between the engaged position or the disengaged position to accommodate the first and second positions of the furnace.

9. The strip mill of claim 4 wherein the roller table has a fixed portion and a traveling portion and wherein the traveling portion is moved to an engaged position aligned with the pass line when the furnace is in the second position and is moved to a disengaged position away from the pass line when the furnace is in the first position.

10. The strip mill of claim 4 further including a gate pivotally mounted to the furnace enclosure to provide a bridge between the roller table and the coiling drum for the strip when the tail of the strip is entering or exiting the furnace and to retract at other times.

11. The strip mill of claim 9 wherein the traveling portion of the roller table is secured to the furnace enclosure such that when the furnace is moved to the first position the traveling portion is moved to the disengaged position and when the furnace is moved to the second position the traveling portion is moved to the engaged position.

12. The strip mill of claim 9 wherein the traveling portion of the roller table moves independently from the furnace between the engaged position or the disengaged position to accommodate the first and second positions of the furnace.

13. The strip mill of claim 5 wherein the roller table has a fixed portion and a traveling portion and wherein the traveling portion is moved to an engaged position aligned with the pass line when the furnace is in the second position and is moved to a disengaged position away from the pass line when the furnace is in the first position.

14. The strip mill of claim 5 further including a gate pivotally mounted to the furnace enclosure to provide a bridge between the roller table and the coiling drum for the strip when the tail of the strip is entering or exiting the furnace and to retract at other times.

15. The strip mill of claim 13 wherein the traveling portion of the roller table is secured to the furnace enclosure such that when the furnace is moved to the first position the traveling portion is moved to the disengaged position and when the furnace is moved to the second position the traveling portion is moved to the engaged position.

16. The strip mill of claim 13 wherein the traveling portion of the roller table moves independently from the furnace between the engaged position or the disengaged position to accommodate the first and second positions of the furnace.

17. In a hot strip mill having a roller mill for working a strip of material, a roller table defining a pass line and positioned on opposite sides of the roller mill to pass the strip of material to and from the roller mill, and a pair of coiling furnaces each having an access opening for both receiving and discharging the strip to a coiling drum mounted within a furnace housing, a method for directing the strip of material to enter and exit one of the coiling furnaces or to proceed along the pass line unobstructed by the coiling furnaces comprising the steps of:

a) positioning the coiling furnace to a first position where the access opening extends into the pass line; and b) positioning the coiling furnace to a second position where the furnace access opening is away from the pass line such that the pass line is unobstructed by the furnace.

18. The method of claim 17 further comprising the steps of:

a) moving a portion of the roller table to a disengaged position away from the pass line when the coiling furnace is in the first position; and b) moving the portion of the roller table to an engaged position aligned with the pass line when the coiling furnace is in the second position.

19. The method of claim 17 wherein the coiling furnace is vertically displaced to assume the first and second positions.

20. The method of claim 17 wherein the coiling furnace is horizontally displaced to assume the first and second positions.

21. The method of claim 18 wherein the coiling furnace and the roller table portion move as a unit.

* * * * *